US011491756B2

(12) United States Patent
Christman et al.

(10) Patent No.: US 11,491,756 B2
(45) Date of Patent: Nov. 8, 2022

(54) MACHINE AND METHOD FOR PRODUCING VOID FILL PACKAGING MATERIAL

(71) Applicant: Sealed Air Corporation (US), Charlotte, NC (US)

(72) Inventors: Russell Christman, Dunstable, MA (US); Thomas Orsini, Sterling, MA (US); Gary Wood, Pelham, NH (US); Stoyanka Kostadinova, Billerica, MA (US); Kostadin Ivanov Kostadinov, Billerica, MA (US)

(73) Assignee: Sealed Air Corporation (US), Charlotte, NC (US)

( * ) Notice: Subject to any disclaimer, the term of this patent is extended or adjusted under 35 U.S.C. 154(b) by 4 days.

(21) Appl. No.: 16/990,217

(22) Filed: Aug. 11, 2020

(65) Prior Publication Data

US 2021/0023809 A1 Jan. 28, 2021

Related U.S. Application Data

(62) Division of application No. 16/339,761, filed as application No. PCT/US2017/055881 on Oct. 10, 2017, now abandoned.

(Continued)

(51) Int. Cl.
*B31D 5/00* (2017.01)

(52) U.S. Cl.
CPC ..... *B31D 5/0047* (2013.01); *B31D 2205/007* (2013.01); *B31D 2205/0047* (2013.01)

(58) Field of Classification Search
CPC .. B31D 5/0047; B31D 5/0039; B31D 5/0043; B31D 5/0052; B31D 5/006;

(Continued)

(56) References Cited

U.S. PATENT DOCUMENTS 4,968,291 A * 11/1990 Baldacci ..... B31D 5/0047 493/464

5,813,967 A 9/1998 Davila (Continued)

FOREIGN PATENT DOCUMENTS

EP 2720859 B1 4/2015
GB 2332193 A 6/1999

OTHER PUBLICATIONS

Written Opinion of the International searching authority in PCT/US2017/055881 dated Apr. 19, 2018.

*Primary Examiner* — Thomas M Wittenschlaeger
(74) *Attorney, Agent, or Firm* — Jon M Isaacson

(57) ABSTRACT

A machine for converting sheet stock material into void fill material comprises an improved, angled inlet chute, an outlet chute, and an internal drive assembly comprising a motor and power transmission system for rotating a plurality of opposed crush wheels that pull the sheet stock from the inlet chute and push the void fill material to the outlet chute in a downstream direction. The internal drive assembly comprises a frame securing a motor and a first power transmission set to rotate a drive axle and a first set of crush wheels. The assembly comprises a subframe securing a driven axle and a second set of crush wheels that are rotated by a second power transmission set. The subframe is pivotably attached to the frame at a pivot point that allows the driven axle to pivot away from the drive axle at least partly in upstream and downstream directions.

8 Claims, 11 Drawing Sheets

Related U.S. Application Data

(60) Provisional application No. 62/406,922, filed on Oct. 11, 2016.

(58) Field of Classification Search
CPC ..... B31D 5/0069; B31D 5/0082; B31D 2205/0047; B31D 2205/007; B31D 2205/0005; B31D 2205/0011; B31D 2205/0052; B31D 2205/0076; B31D 2205/0082; B31F 1/07; B31F 2201/07; B31F 2201/0753; B31F 2201/0715
See application file for complete search history.

(56) References Cited

U.S. PATENT DOCUMENTS 5,829,231 A 11/1998 Harding et al.
5,902,223 A 5/1999 Simmons
5,906,569 A * 5/1999 Ratzel ..... B26D 1/245 493/464
5,921,907 A 7/1999 Beierlorzer
6,019,715 A * 2/2000 Ratzel ..... B31D 5/0047 493/464
6,026,632 A 2/2000 Simmons
6,033,353 A 3/2000 Lencoski et al.
6,168,559 B1 1/2001 Simmons
6,168,560 B1 * 1/2001 Pluymaekers ..... B31D 5/0047 493/464
6,176,818 B1 * 1/2001 Simmons, Jr. ..... B31D 5/0047 493/464
6,240,705 B1 6/2001 Simmons et al.
6,311,596 B1 11/2001 Ratzel et al.
6,387,029 B1 5/2002 Lencoski
6,416,451 B1 7/2002 Ratzel et al.
6,468,197 B1 10/2002 Lencoski
6,561,964 B1 * 5/2003 Armington ..... B31D 5/0047 493/464
6,626,813 B1 9/2003 Ratzel et al.
6,676,589 B2 1/2004 Kung et al.
6,688,366 B1 * 2/2004 Gambini ..... B31F 1/07 156/582
7,041,043 B2 5/2006 Lucassen et al.
7,426,886 B2 * 9/2008 Spatafora ..... B31F 1/07 101/6
7,740,573 B2 * 6/2010 Manley ..... B31D 5/0047 493/464
7,955,245 B2 6/2011 Cheich et al.
8,501,302 B2 * 8/2013 Hau ..... B32B 3/02 428/167
9,205,621 B2 * 12/2015 Cheich ..... B31D 5/0069
9,764,939 B2 * 9/2017 Brunnert ..... B26F 1/24
9,884,465 B2 * 2/2018 Sip ..... B31D 5/0043
2002/0137617 A1 * 9/2002 Kobben ..... B26D 1/30 493/350
2009/0082187 A1 * 3/2009 Cheich ..... B31D 5/0047 53/472
2012/0289392 A1 * 11/2012 Cheich ..... B31D 5/0047 493/464
2014/0113794 A1 * 4/2014 Deis ..... B31D 5/006 493/464

* cited by examiner

MACHINE AND METHOD FOR PRODUCING VOID FILL PACKAGING MATERIAL

CROSS-REFERENCE TO RELATED APPLICATIONS

This application is a divisional of U.S. patent application Ser. No. 16/339,761, filed Apr. 5, 2019, which is a national stage under 35 U.S.C. § 371 of International Application No. PCT/US2017/055881, filed Oct. 10, 2017, which claims the benefit of U.S. Provisional Application No. 62/406,922, filed Oct. 11, 2016, the contents of each of which are hereby incorporated by reference in their entirety.

BACKGROUND

The present invention relates generally to dunnage or packaging materials and, more specifically, to a machine and method for producing package void fill material from sheets of a selected substrate, such as paper.

Machines for producing void fill material from paper are well-known in the art. Such machines generally operate by pulling a web of paper from a roll or fanfold paper, manipulating the paper web in such a way as to convert the paper into void fill material, and then severing the converted material into cut sections of a desired length.

While such machines are widely used and have been commercially successful, in many applications, there is a need for improved functionality. For example, crush wheels and severing mechanisms in paper conversion machines produce the desired lengths of converted material, but these mechanisms present ongoing safety concerns, in both the design and operation of such machines. Thus, appropriate safeguards can make it safer for operators using the machine.

Another area requiring improved functionality is in the reduction of paper jams. In converting flat webs of a substrate into void fill material, the substrate material is pulled from a supply into a machine inlet, crushed to form a more dense material, and pushed out of a machine outlet. Paper jams can occur at or near the crush wheels and the machine outlet. Accordingly there is a need in the art for an improvement to sheet-fed void fill conversion machines that will reduce or prevent paper jams while still allowing higher-density void fill material to be produced.

SUMMARY

The present invention relates to a machine for converting sheet stock material into a three dimension void fill material. In one embodiment, the machine may comprise an inlet chute, an outlet chute, and an internal drive assembly comprising a motor and power transmission system for rotating a plurality of opposed crush wheels. The crush wheels pull the sheet stock from the inlet chute and push the void fill material to the outlet chute all in a downstream direction, the internal drive assembly further comprises a frame securing a drive motor and a first power transmission set adapted to rotate a drive axle on which a first set of crush wheels are rotated. The internal drive assembly also includes a subframe securing a driven axle on which a second set of crush wheels are rotated. A second power transmission set is adapted to rotate the driven axle in synchronous rotation with the drive axle about substantially parallel axes of rotation. The subframe is pivotably attached to the frame at a pivot point located laterally outside of a space between the opposed crush wheels and at a position that allows the subframe to pivot at least partly in the downstream direction and an opposite upstream direction. In one embodiment, the subframe comprises first and second floating plates which pivotably secure first and second ends of the driven axle to the frame. Each floating plate may be independently pivotable about the pivot point and urged to a closed position by a biasing element.

In one embodiment, the pivot point is located at a position downstream of the axes of rotation for the drive and driven axles. In one embodiment, the driven axle and second set of crush wheels are displaceable away from the drive axle and the first set of crush wheels at least partly in the upstream direction. The first and second sets of crush wheels have protrusions that define an outer swept diameter. When the driven axle and the second set of crush wheels are not displaced in the upstream direction, the outer swept diameters of the first and second set of crush wheels overlap. In contrast, when the driven axle and the second set of crush wheels are displaced in the upstream direction, the outer swept diameters of the first and second set of crush wheels do not overlap. When the driven axle and the second set of crush wheels are displaced in the upstream direction so that the outer swept diameters of the first and second sets of crush do not overlap, the second power transmission set continues to rotate the driven axle in synchronous rotation with the drive axle.

In another embodiment, a machine for converting sheet stock material into a three dimension void fill material may comprise an inlet chute, an outlet chute, and an internal drive assembly comprising a motor and power transmission system for rotating a plurality of opposed crush wheels, the crush wheels pulling the sheet stock from the inlet chute and pushing the void fill material to the outlet chute all in a downstream direction, the inlet chute further comprising an internal volume defined by opposed top and bottom walls and opposed side walls. The spacing between the top and bottom walls is smallest at an upstream location nearest an inlet port and gradually increases in a downstream direction at a location nearest the crush wheels. In contrast, spacing between the side walls is largest at an upstream location nearest the inlet port and gradually decreases in a downstream direction at a location nearest the crush wheels. The inlet chute further comprises an angled inlet port having a lower inlet surface and an upper overhang that extends beyond the lower inlet surface in an upstream direction opposite the downstream direction and the inlet port is angled relative to the downstream direction to block a spacing between the top and bottom walls taken along a direction perpendicular to the downstream direction at a location where the lower inlet surface is closest to the top wall. In one embodiment, the upper overhang extends downward by a distance that is at least one fourth of the spacing between the top and bottom walls.

DETAILED DESCRIPTION

Figure 1A:
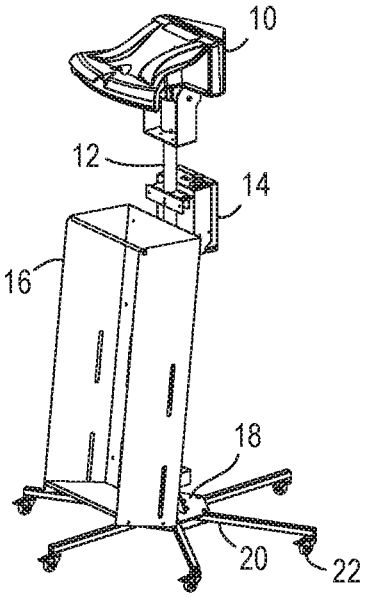
FIG. 1A is an isometric view of a machine for producing void fill material mounted on a floor stand according to one embodiment of the present invention.
Figure 1B:
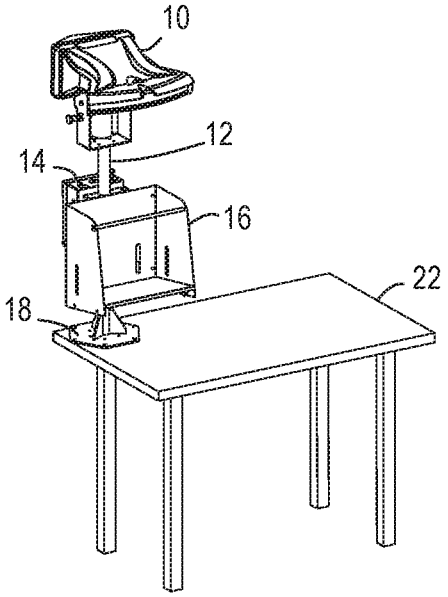
FIG. 1B is an isometric view of a machine for producing void fill material mounted on a table according to one embodiment of the present invention.

Referring now to the Figures, embodiments of a machine 10 for producing package void fill material from sheets of a selected substrate are illustrated. FIGS. 1A and 1B depict different implementations of such a machine 10. FIG. 1A shows a machine 10 in a floor stand configuration while FIG. 1B shows a machine 10 in a tabletop configuration. In either configuration, the machine 10 may be secured to a support stand 12, which may be height adjustable. Other related components, such as a control unit 14, a sheet supply bin 16, and a support base 18 may also be connected to the stand 12. The control unit 14 may include a user interface or other user operable switches, buttons, dials or other controls to manage operation of the machine 10. For example, the control unit 14 may include an emergency stop button or other controls that allow an operator to adjust modes of operation or to select a particular length of void fill material to dispense. The sheet supply bin 16 is sized and shaped to accommodate different sheet sizes and densities. In one embodiment, the size of the supply bin 16 may be adjustable to accommodate different sheet supply widths, for example 15" or 30" wide fanfold stock. In another embodiment, a sheet of void fill material can be supplied to the machine 10 in the form of a roll of stock sheet material. Thus, a horizontal bar (not shown) might be secured nearby or directly to the stand 12 to support such a roll of stock sheet material. In one embodiment, the sheet supply bin 16 might be positioned near, but not directly coupled to the machine 10. The support base 18 secures stand 12 to a stable platform such as legs 20, casters 22, table 24 or other mounting locations such as a work bench or a product conveyor. The support base 18 may be secured to a fixed or mobile platform as appropriate depending on the requirements of a particular packaging environment.

Figure 2:
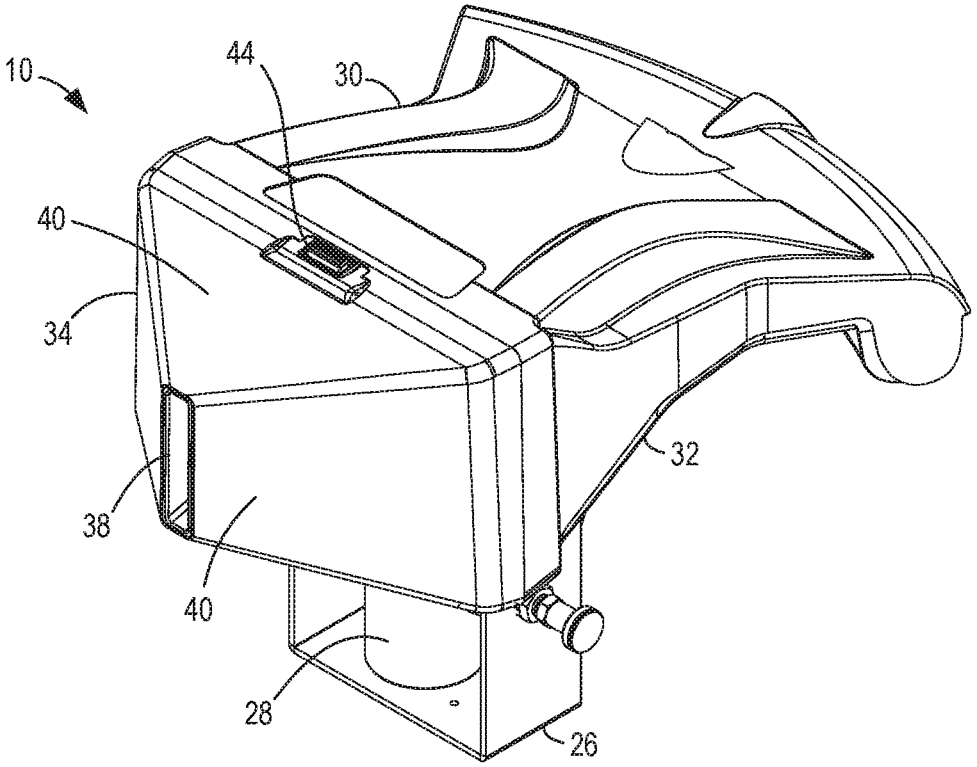
FIG. 2 is an isometric view of a machine for producing void fill material according to one embodiment of the present invention.
Figure 3:
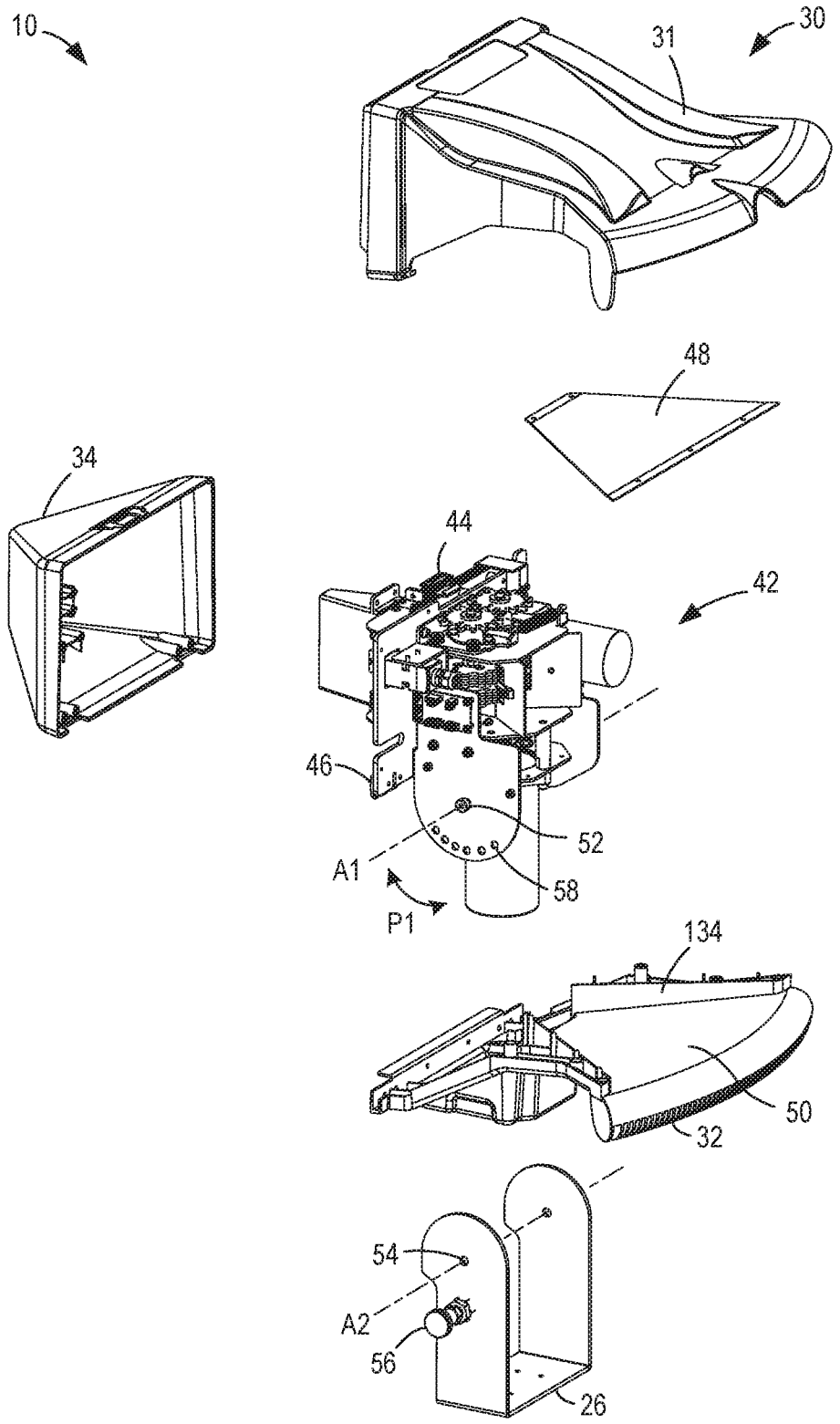
FIG. 3 is an isometric exploded view of a machine for producing void fill material according to one embodiment of the present invention.

FIG. 2 illustrates an isometric view of the machine 10 looking generally from an outlet side of the machine. Also visible in FIG. 2 is an associated mount 26 and drive motor 28, illustrated elsewhere and described in greater detail below. FIG. 3 shows an exploded isometric view of the machine looking generally from an inlet side of the machine 10. The machine 10 includes a plurality of covers safely enclosing the moving components of the machine. In the embodiment shown, the machine 10 includes a top shell 30, a bottom shell 32, and an outlet shell 34. The top, bottom, and outlet shells 30, 32, 34 may be constructed of strong, lightweight materials. The top and bottom shells 30, 32 cooperate to form a sheet supply inlet chute 36 as shown more clearly in FIGS. 13A-13D and described in greater detail below. The outlet shell 34 includes a pyramidal shape with sidewalls 40 converging at an opening defining an outlet port 38 through which the void fill material is dispensed. In the illustrated embodiment, the outlet port 38 is elongated, substantially rectangular, and vertically oriented to accommodate void fill material having a similar cross section that is generated by the machine 10. Other shapes, sizes and orientations for the outlet port 38 are permissible depending on how the machine 10 converts the sheet supply into the void fill material. For instance, if the sheet crush wheels 80 (described below and shown at least in FIG. 4) are configured or oriented differently, the void fill material may emerge from the machine with a horizontally-elongated cross section or perhaps with a tubular cross section. Accordingly, the outlet port 38 should be sized and shaped to accommodate the typical cross section of the converted void fill material. In the illustrated embodiment, the outlet shell 34 is pivotably attached to the internal drive assembly 42 via hinges 46 and latch 44. The outlet shell 34 can be opened and pivoted down, thus providing access to easily service or clear occasional jams from the internal drive assembly 42.

The top shell 30 covers the uppermost portions of the internal drive assembly 42. The top shell 30 is preferably lightweight but strong enough to adequately protect and enclose the internal drive assembly 42. The outer surface 31 of the top shell 30 may include aesthetic design elements including curves and contours to improve product appearance. To decrease weight, the top shell 30 may be designed to have thin walls, which means the inner surface of the top shell 30 may have a similar shape as the outer surface 31. Consequently, the inner surface of the top shell 30 may have curves and contours that may cause sheet stock to drag or catch on the inner surface of the top shell 30. Therefore, an optional inlet chute panel 48 may be secured to the inside of the top shell 30 so that sheet stock being pulled into the machine 10 is guided to the crush wheels 80 along a smooth surface, thus reducing the likelihood that the sheet stock drags or gets caught or snagged within the inlet.

By comparison, the embodiment of bottom shell 32 illustrated in the figures has a chute surface 50 that also provides a smooth transition through the chute 36 to the crush wheels 80. The chute surface 50 may be formed as part of the bottom shell 32, such as during a molding process. Alternatively, a separate chute panel 48 may be attached to the bottom shell to 32. In an alternative embodiment, the top and bottom shells 30, 32 include integral chute surfaces 50. In an alternative embodiment, the top and bottom shells 30, 32 include separately attached chute panels 48. In an alternative embodiment, the top shell includes an integral chute surface 50 while the bottom shell 32 includes a separately attached chute panel 48. The top, bottom, and outlet shells 30, 32, 34 and chute panel 48 may be constructed of a variety of rigid or semi-rigid materials known in the art, including (but not limited to) plastic, metal, fibrous materials, foamed plastics, recycled materials, and/or combinations thereof. Some examples of techniques suitable for manufacturing the shells 30, 32, 34 and panel 48 include molding, stamping, casting, rolling, forming, machining three dimensional printing, and the like.

In the embodiment shown in FIG. 2, the shells 30, 32, 34 cover much of the internal drive assembly 42 except for mount 26 and drive motor 28. The mount 26 is attachable to a stand 12 or other support structure at a fixed height or height adjustable as suitable for a particular user and application. The internal drive assembly 42 attaches to the mount 26 and is pivotable about axis A1 as shown by arrow P1. When assembled, the mounting holes 52 defining axis A1 on internal drive assembly 42 align to mounting holes 54 defining axis A2 on mount 26 (i.e., axes A1 and A2 are coaxial). A desired pivot orientation for the internal drive assembly 42 is selected by aligning an indexing plunger 56 or other quick release hardware to a desired one of a plurality of adjustment apertures 58.

Figure 4:
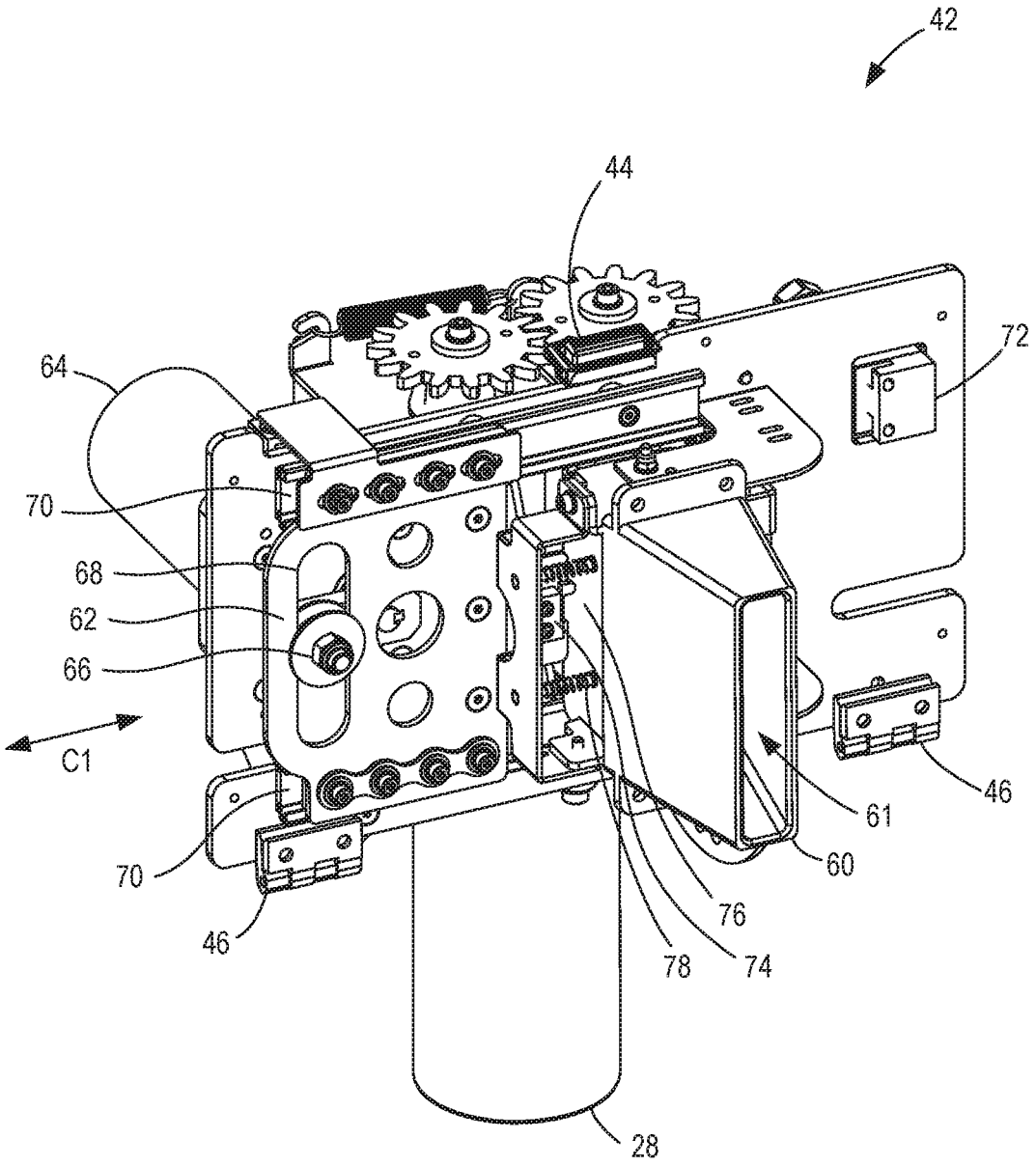
FIG. 4 is an isometric view of an internal drive assembly of a machine for producing void fill material according to one embodiment of the present invention.

FIG. 4 illustrates an isometric view of the internal drive assembly 42 looking generally from an outlet side of the machine. The internal drive assembly 42 includes an outlet chute 60 defining an interior volume 61 sized and shaped to allow void fill material to pass within. The outlet chute 60 directs void fill material that has been converted by crush wheels 80 toward the outlet port 38 in the outlet shell 34. The outlet chute 60 may be secured to the internal drive assembly 42 as shown or alternatively to the inside of the outer shell 34 so that void fill material being pushed along by the crush wheels 80 is ejected from the machine 10 along a smooth surface, thus reducing the likelihood that the void fill material drags or gets caught or snagged within the outlet. Alternatively, the outlet chute 60 may formed integrally as part of the outlet shell 34.

The illustrated embodiment of an internal drive assembly 42 also includes a cutting blade 62 that is driven by cutting motor 64 to move in the direction of arrow C1, and generally perpendicular to the direction of travel of void fill material exiting the internal drive assembly 42. An eccentric bearing 66 is coupled to the cutting motor 64 so that it travels in a circular path as the cutting motor 64 turns. The eccentric bearing 66 sits within a slot 68 in the cutting blade 62. As the eccentric bearing 66 rotates along its circular path, it will move up and down within the slot 68 and cause the cutting blade 62 to move laterally along linear bearings 70 in the direction of arrow C1. Thus, when a desired amount of void fill material is produced by the internal drive assembly 42, the control unit 14 or an operator alone or in combination with control unit 14 will cause the cutting motor to rotate one full rotation. Each full rotation of the cutting motor 64 causes the cutting blade 62 to move laterally one full cycle to contact and cut the void fill material and then return to the home position shown in FIG. 4. Then, the cut void fill material will fall from or can be pulled from the machine 10.

The illustrated embodiment of an internal drive assembly 42 also includes an interlock safety switch 72. The safety switch 72 is a non-defeatable safety measure that ensures the outlet cover 34 is closed and secured before the internal drive assembly 42 operates. The safety switch 72 will put the machine 10 into emergency stop mode if the outlet cover 34 is open.

The illustrated embodiment of an internal drive assembly 42 also includes a jam detection switch 74. Springs 78 push a movable flap 76 towards a normal operating position where the flap 76 forms a part of the side wall of the outlet chute 60. In the event of a jam of void fill material downstream of the crush wheels 80 within the inner volume 61 of outlet chute 60, the accumulation of excess void fill material will cause the flap to deflect laterally outward, away from the inner volume 61 of the chute 60 and actuate the switch 74. When actuated, the jam switch 74 will cause the drive motor 28 to stop rotating or put the machine 10 into emergency stop mode to cease the feeding of the sheet stock. Once a jam is cleared, the flap 76 can return to its normal operating position where switch 74 is no longer actuated.

FIG. 4 illustrates an isometric view of the internal drive assembly 42 looking generally from an inlet side of the machine and showing only certain components of the crush wheel drivetrain 82. The crush wheel drivetrain 82 operates to rotate the crush wheels 80 to convert a supply of sheet stock into void fill material. Components of the crush wheel drivetrain 82 are supported by a frame 83 that includes an upper wall 84, lower wall 86, and sidewalls 88 that converge in a downstream direction (indicated by arrows D1) to feed sheet stock from the inlet chute 36 to the crush wheels 80. In the illustrated embodiment, the crush wheels 80 are disposed between the upper and lower walls 84, 86. Other portions of the crush wheel drivetrain 82 are located above the upper wall 84 or below the lower wall 86 isolated from the travel path of the sheet stock and void fill material. For example, the drive motor 28 is secured to a motor mounting plate 90 below the lower wall 86 with a plurality of standoffs 92.

Figure 5:
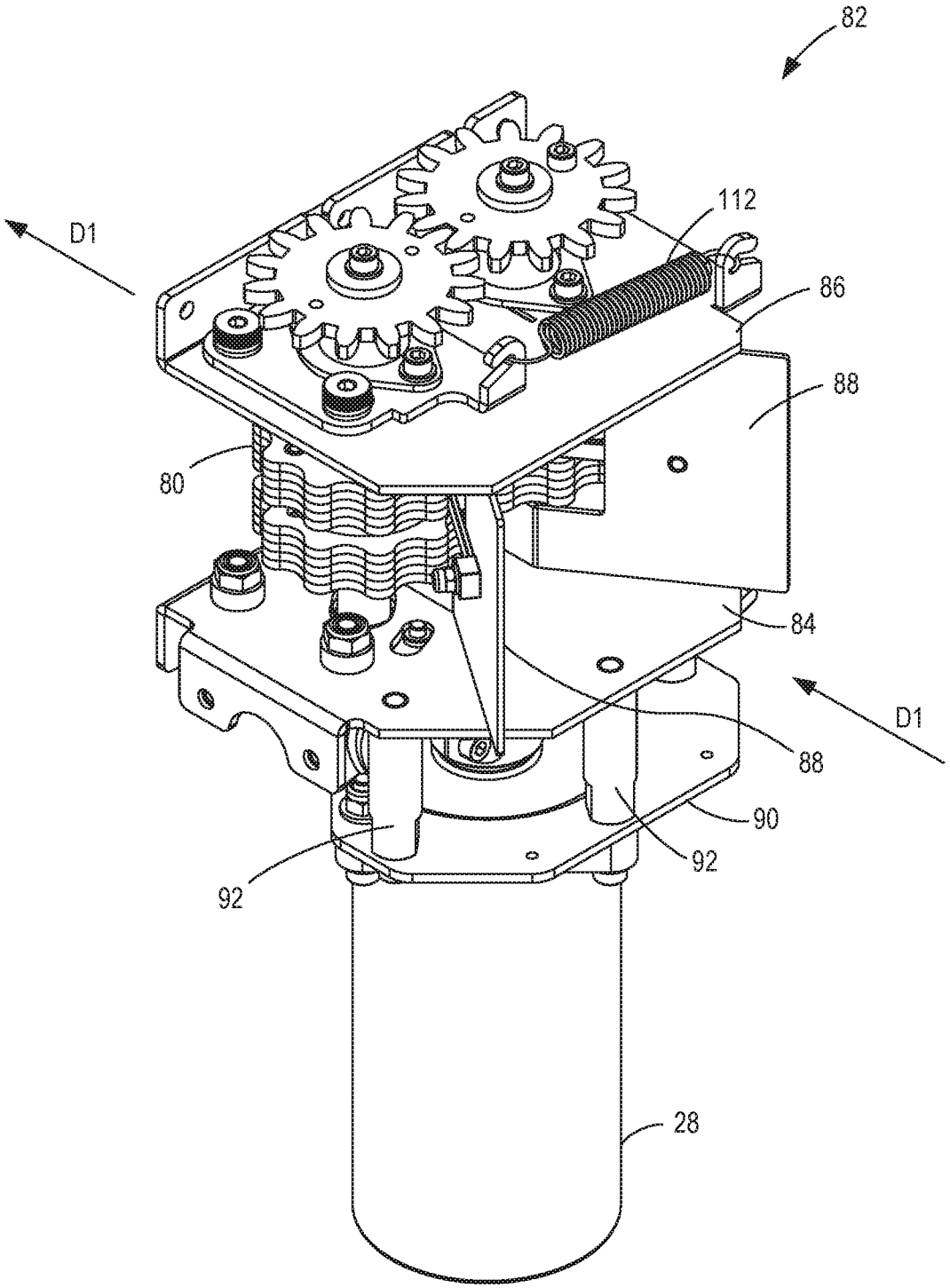
FIG. 5 is an isometric view of crush wheel drivetrain assembly of a machine for producing void fill material according to one embodiment of the present invention.
Figure 12:
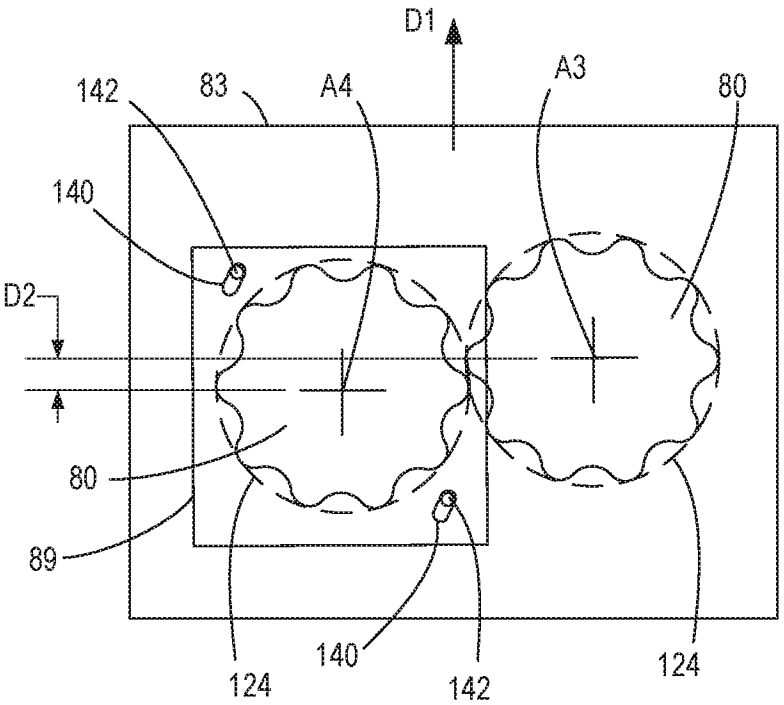
FIG. 12 is a schematic representation of a crush wheel mounted on a translating subframe according to one embodiment of the present invention.

In one aspect of the present invention, the spacing between crush wheels 80 which convert a supply of sheet stock into void fill material is expandable in the event of a jam to prevent catastrophic failures or damage to the crush wheel drivetrain 82. To achieve this expandable spacing between the crush wheels 80, one set of rotating crush wheels is fixedly mounted to the upper and lower walls 84, 86, while the other set of rotating crush wheels 80 is mounted to a subframe 89 that is movably secured to the upper and lower walls 84, 86 and permits the second set of crush wheels 80 to move away from the first. More specifically, the second set of crush wheels are mounted to upper and lower floating plates 108, 110 that are movably coupled to the upper and lower walls 84, 86, respectively. A biasing element 112 urges the upper and lower floating plates 108, 110 to a closed operating position where the opposed crush wheels 80 are closest to each other and cooperate to convert sheet stock to void fill material. In FIG. 5, only one biasing element and upper floating plate 108 are visible. The lower floating plate 110 and its own biasing element 112 are coupled underneath lower wall 86 and not visible in FIG. 5. In the illustrated embodiment, the biasing element is an extension spring. In other embodiments, other types of springs, including for example compression springs, torsion springs, coil springs and the like may be used. In one embodiment, the subframe may include a single movable structure or plate that supports the second set of crush wheels 80 and allows the second set of crush wheels 80 to move away from the first. For example, the subframe may be implemented as only one but not the other of the floating plates 108, 110. In an alternative embodiment, the floating plates 108, 110, may be coupled to one another to form a single pivoting structure. In an alternative embodiment, the subframe is moveable in a purely translatable manner as shown in FIG. 12, for example.

Figure 7:
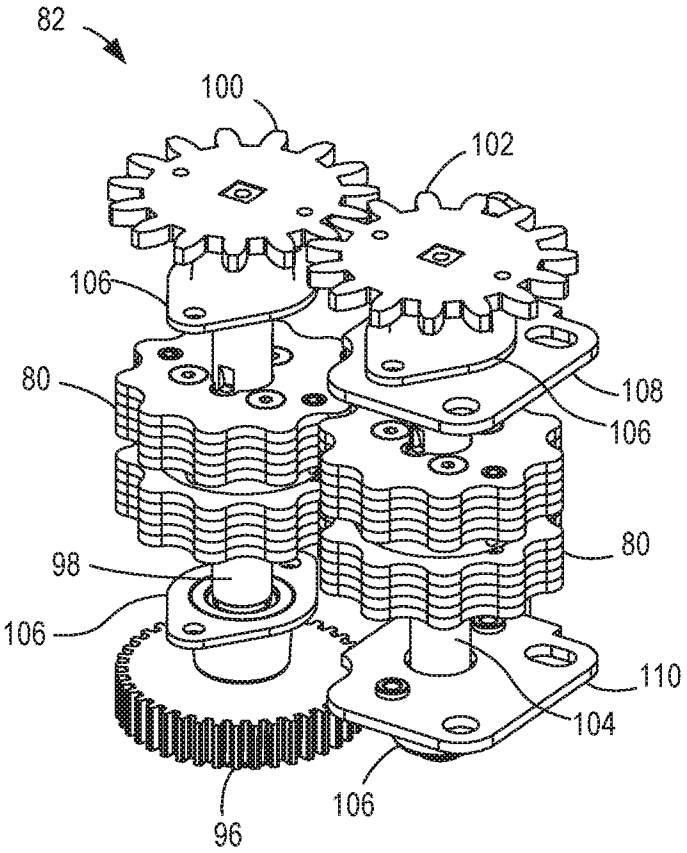
FIG. 7 is a simplified isometric view of crush wheel drivetrain assembly of a machine for producing void fill material according to one embodiment of the present invention.
Figure 6:
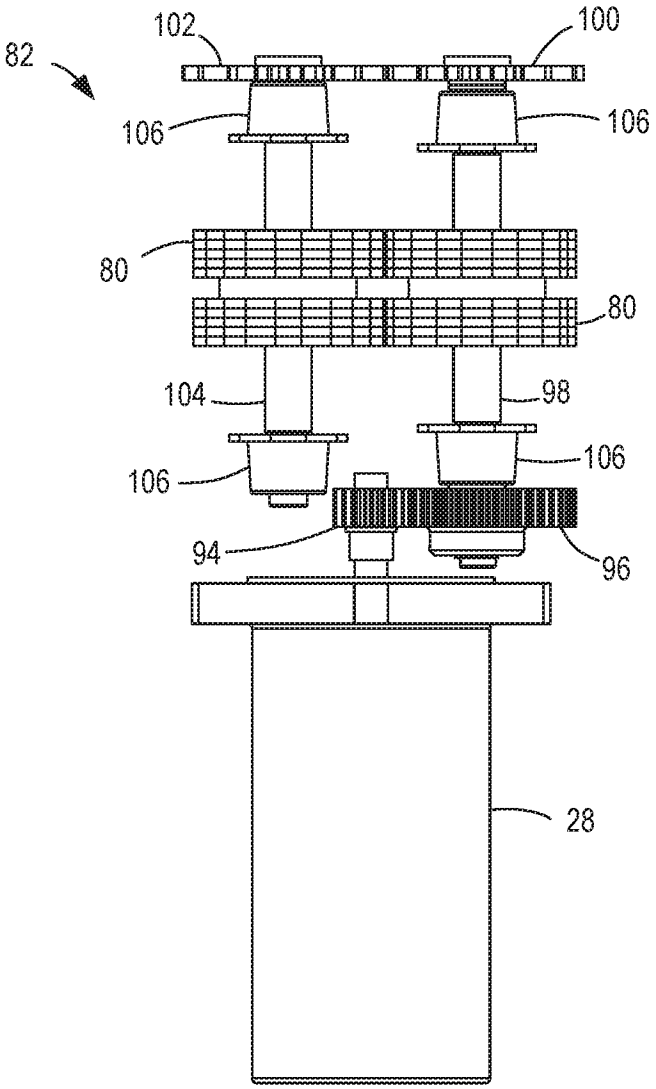
FIG. 6 is a side view of crush wheel drivetrain assembly of a machine for producing void fill material according to one embodiment of the present invention.

FIGS. 6 and 7 illustrate simplified views of the crush wheel drivetrain 82 without hardware and without the upper wall 84, lower wall 86, and sidewalls 88. FIG. 6 represents a side view of the crush wheel drivetrain 82 viewed from the inlet side in a downstream direction. FIG. 7 represents an isometric view of the crush wheel drivetrain 82 looking generally from an outlet side of the machine and without the drive motor 28. In the illustrated embodiment, the crush wheel drive train 82 is driven by a drive motor 28 with a power transmission set for translating rotational power from the motor 28 to the drive axle 98. In the illustrated embodiment, the power transmission set includes set of mated gears, including a pinion gear 94 secured to the motor shaft. The pinion gear 94 is mated to and rotates a main drive gear 96 that is secured to a bottom end of a drive axle 98. The mating set of pinion gear 94 and drive gear 96 are sized to have a gear ratio that causes the drive gear 96 to rotate at a speed that is lower than the rotation speed of the pinion gear 94. In one embodiment, the gear ratio between the pinion gear 94 and drive gear 96 is selected to be in the range between 1:1 and 1:5. The drive motor 28 and pinion gear 94 may operate at a rotation speed between about 600 and 3000 rpms to rotate the crush wheels 80 at a rotation speed of about 300 to 800 rpms, which translates to a sheet stock feed rate of about 5 to 9 feet per second. Those skilled in the art will appreciate that other operating speeds and other gear ratios between the pinion gear 94 and drive gear 96 are possible based in part on the availability of efficient motors capable of operating at a desired rotation speed. The characteristics of the sheet stock 116 may also contribute to determining a desirable feed rate. In another embodiment, the gear ratio between the pinion gear 94 and drive gear 96 is selected to be 1:1. In one embodiment, a larger gear may be secured to the shaft of motor 28 and a smaller gear secured to the drive axle 98. Those skilled in the art should also appreciate that other power transmission systems for transmitting rotational speed from the motor to the crush wheels are contemplated. For example, in an alternative embodiment, the drivetrain 82 may include a power transmission set comprising a belt driven by pulleys. The pulleys may have different sizes to achieve a desired drive ratio.

A first set of crush wheels 80 are coupled to and rotate with the rotating drive axle 98. A separate power transmission set translates rotational power from the drive axle 98 to a driven axle 104. In the illustrated embodiment, the secondary power transmission set includes a second set of gears, including a drive spur gear 100 that is coupled to the end of the drive axle 98 opposite the drive gear 96. The drive spur gear 100 is mated to and rotates a driven spur gear 102 that is secured to a top end of a driven axle 104. Whereas the gear ratio between pinion gear 94 and drive gear 96 may be a ratio other than 1:1, the gear ratio between the drive and driven spur gears 100, 102 is set to be 1:1 so that the drive axle 98 and driven axle 104 rotate at the same rotational speed. A second set of crush wheels 80 are coupled to and rotate with the rotating driven axle 104. The illustrated crush wheels 80 include a stacked set of laser cut sheet metal plates. In other embodiments, cast, molded, forged, plastic or metal crush wheels 80 may be used. In an alternative embodiment, the driven axle 104 is rotated by drive axle 98 through a power transmission system comprising belts and pulleys instead of gears. A belt drive system must accommodate the pivotable upper and lower floating plates 108, 110, which can be accomplished through such components as a variable pulleys, variable belts, or more sophisticated designs known in the art of belt drive systems. In yet another embodiment, the driven axle 104 may be rotated by motor 28 and the second power transmission set, and not by the drive axle 98.

In the embodiment shown, the drive axle 98 is coupled to the upper and lower walls 84, 86 by bearings 106. Thus, the drive axle 98 and its associated crush wheels 80 and gears 96, 100 are able to rotate, but are not able to move in a lateral direction. Opposite ends of the driven axle 104 are respectively coupled to the upper and lower floating plates 108, 110 by bearings 106. Thus, in contrast to drive axle 98, the driven axle 104 and its associated crush wheels 80 and gear 102 are able to rotate under the influence of the meshed spur gears 100, 102, but are also able to move in a lateral direction in the event of a jam.

Figure 8B:
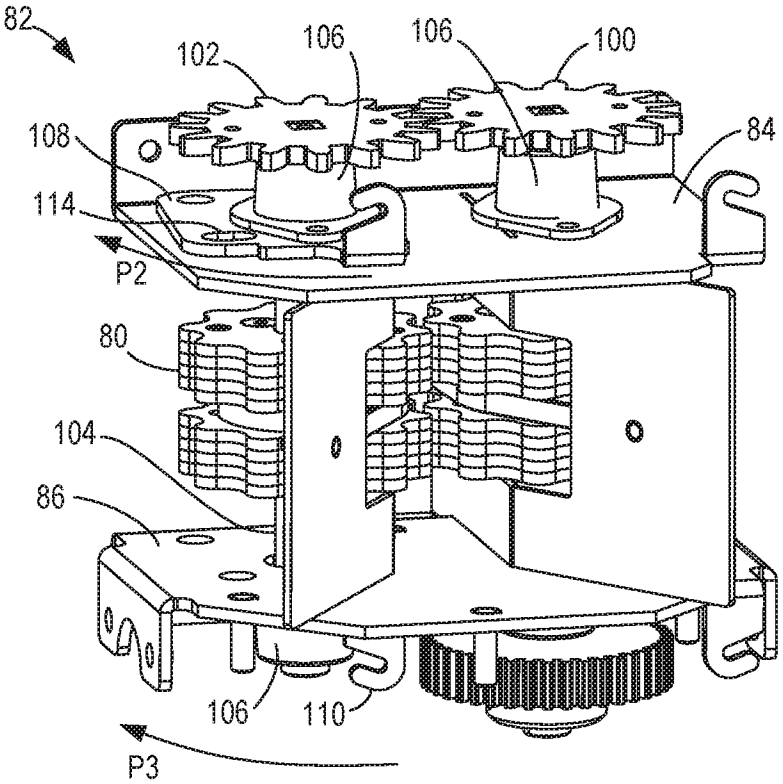
FIG. 8B is an isometric view of a crush wheel drivetrain assembly of a machine for producing void fill material in which a driven set of crush wheels is in an open position according to one embodiment of the present invention.
Figure 8A:
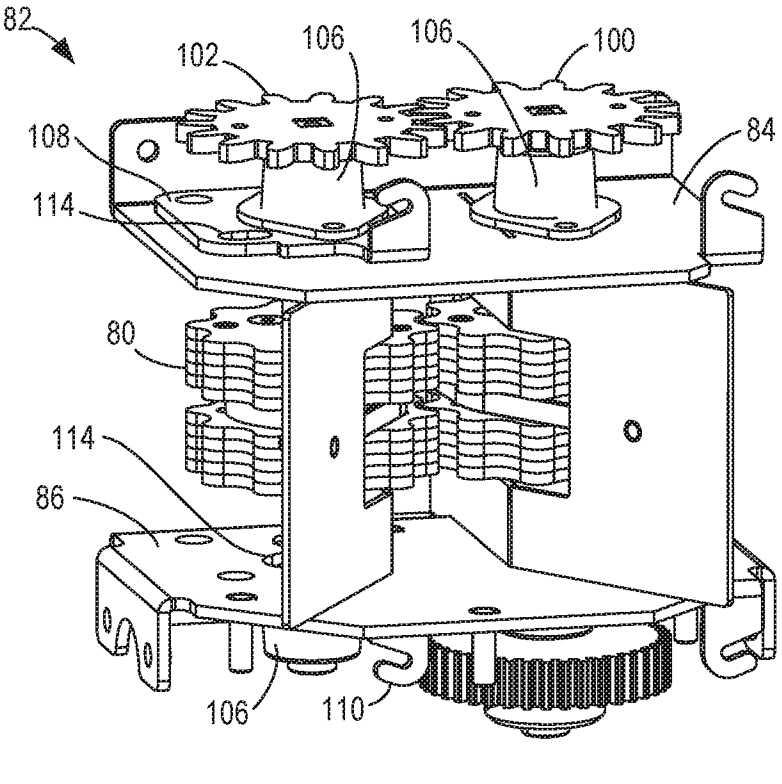
FIG. 8A is an isometric view of a crush wheel drivetrain assembly of a machine for producing void fill material in which a driven set of crush wheels is in a closed position according to one embodiment of the present invention.
Figure 9B:
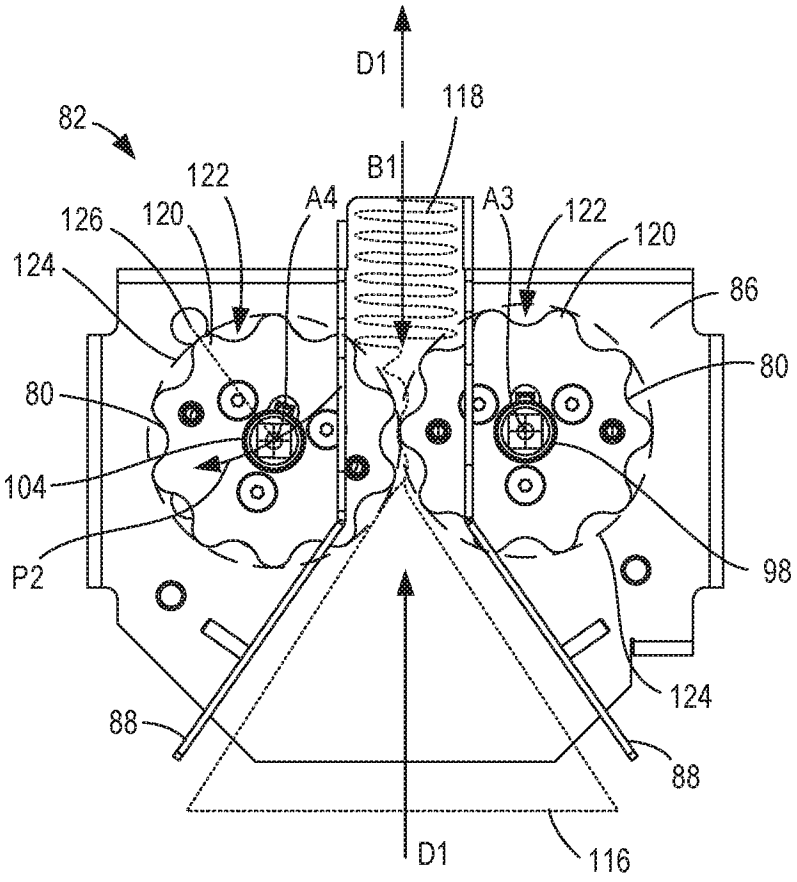
FIG. 9B is a top simplified view of a crush wheel drivetrain assembly of a machine for producing void fill material in which a driven set of crush wheels is in an open position according to one embodiment of the present invention.
Figure 9A:
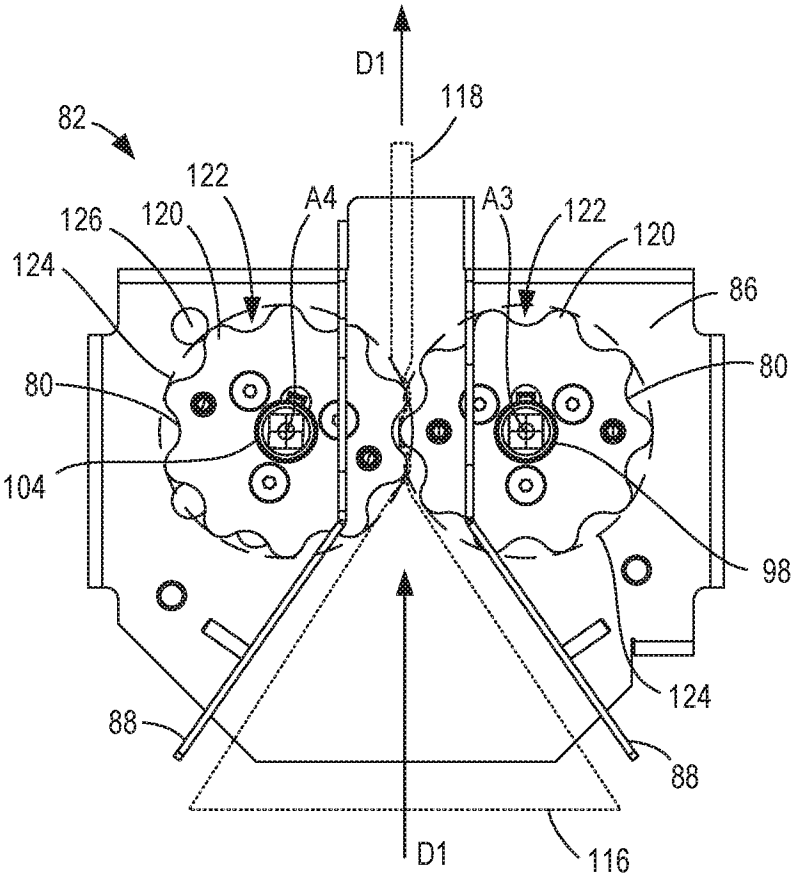
FIG. 9A is a top simplified view of a crush wheel drivetrain assembly of a machine for producing void fill material in which a driven set of crush wheels is in a closed position according to one embodiment of the present invention.
Figure 10B:
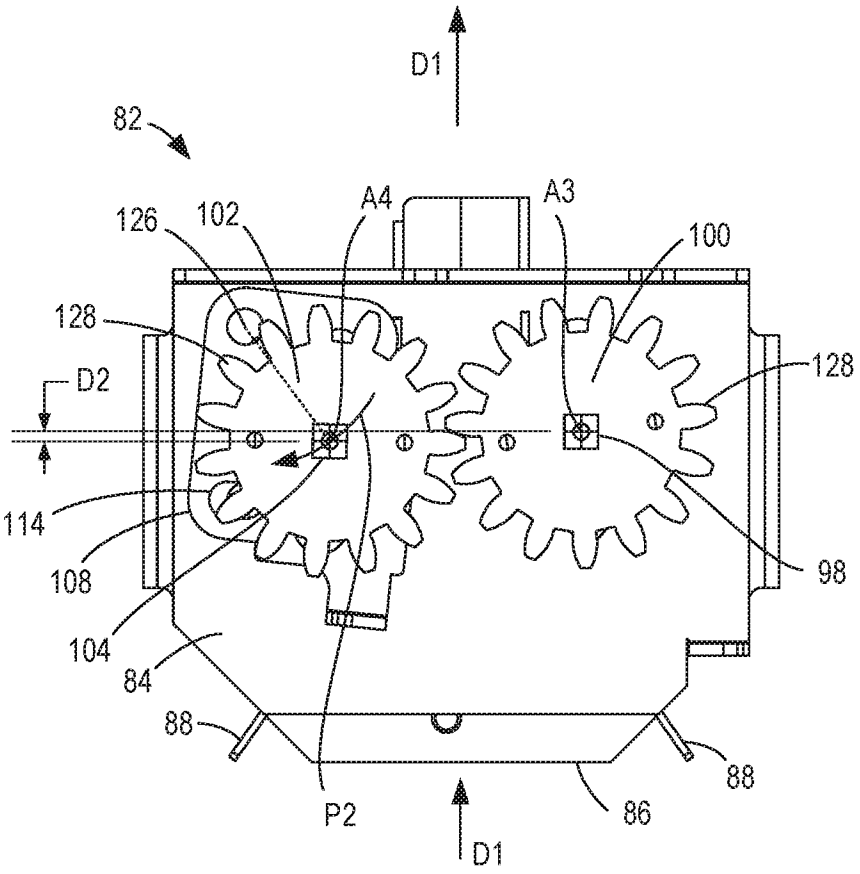
FIG. 10B is a top view of a crush wheel drivetrain assembly of a machine for producing void fill material in which a driven set of crush wheels is in an open position according to one embodiment of the present invention.
Figure 10A:
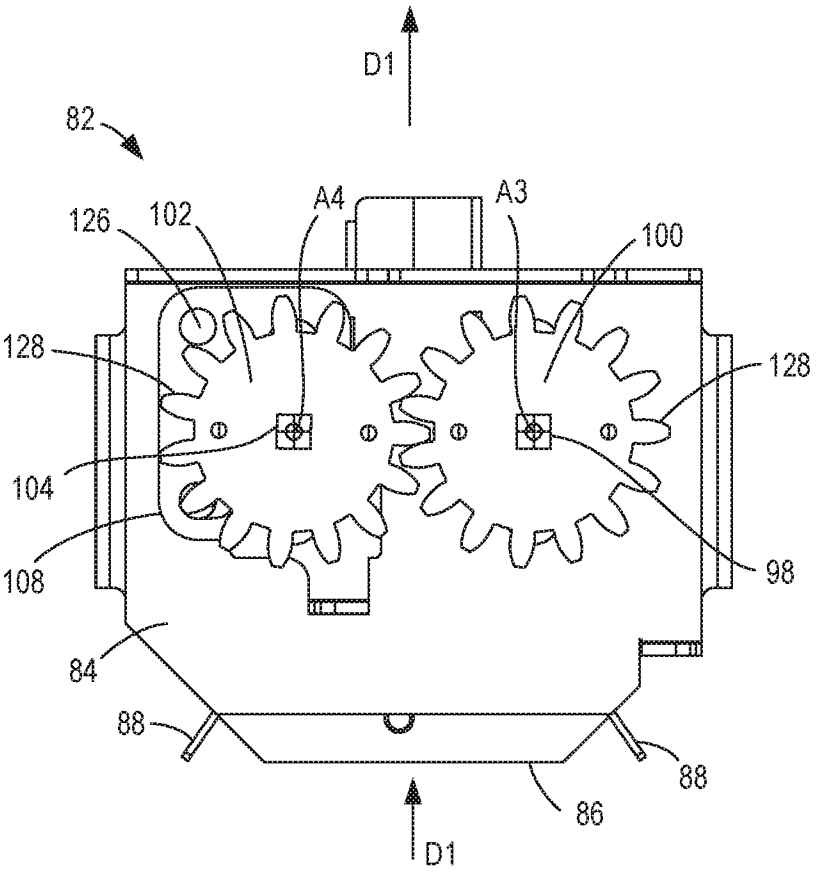
FIG. 10A is a top view of a crush wheel drivetrain assembly of a machine for producing void fill material in which a driven set of crush wheels is in a closed position according to one embodiment of the present invention.

FIGS. 8A-8B, 9A-9B, and 10A-10B illustrate matched sets of views with FIGS. 8A, 9A, and 10A depicting the crush wheel drivetrain 82, and specifically the driven axle 104 and its associated crush wheels 80 and gear 102 in a closed operating position so that the crush wheels 80 are positioned to convert sheet stock into void fill material. In contrast, FIGS. 8B, 9B, and 10B depict the driven axle 104 and its associated crush wheels 80 and gear 102 displaced as indicated by arrow P2. In this jammed configuration, the crush wheels 80 on the drive and driven axles 98, 104 disengage from each other to stop converting sheet stock into void fill material. In the case of FIGS. 8A & 8B, each figure shows an isometric view of the crush wheel drivetrain 82 looking generally from an inlet side of the assembly. FIG. 8B shows upper floating plate 108, lower floating plate 110, and the respective bearings 106 displaced as shown by arrow P2. Driven axle 104, which is rotatably coupled to bearings 106, and the crush wheels 80 mounted to driven axle 104 are also displaced outward. In one embodiment, the bearings 106 are radial bearings, in which case, the driven axle 104 will be maintained substantially parallel to drive axle 102 whether the driven axle 104 is in a closed operating position (FIG. 8A) or in a jammed or displaced position as in FIG. 8B. In the illustrated embodiments, the bearings are self-align bearings, which allow driven axle 104 to tilt a small amount so that driven axle 104 and drive axle 98 are not strictly parallel, depending on the nature of a particular jam. Thus, for example, the upper floating plate 108 may be displaced a first amount indicated by arrow P2 while lower floating plate 110 may be displaced a second, different amount indicated by arrow P3. A plurality of slots 114 are included in the upper and lower floating plates 108, 110, and in the upper and lower walls 84, 86, to accommodate the displacement of the driven axle 104 and components and hardware attached thereto.

FIGS. 9A & 9B show top views of the crush wheel drivetrain 82 with the upper wall 84 and components above upper wall 84 removed. Thus, the Figures show the drive axle 98, driven axle 104, and the crush wheels 80 mounted thereon. As oriented, the downstream direction is towards the top of the page and is indicated by arrow D1. FIGS. 9A & 9B also show the lower wall 86 and side walls 88 that converge to guide sheet stock 116 (depicted by a dotted line) towards the crush wheels 80 where the sheet material is converted into void fill material 118 (also depicted by a dotted line). FIGS. 9A & 9B also show that crush wheels 80 have a plurality of teeth or protrusions 120 and recesses 122 in the spaces between the protrusions. The crush wheels 80 on the drive and driven axles 98, 104 are not necessarily in contact with each other. However, as the crush wheels 80 rotate, the protrusion 120 of one set of crush wheels 80 (on either of the drive or driven axle 98, 104) engage the recess 122 on the opposed crush wheel 80 (on the other of the drive or driven axle 98, 104) in a meshed rotation. In a preferred implementation, the crush wheels 80 rotate at a common speed so that they remain in synchronized, meshed rotation. In the illustrated embodiment, the protrusions 120 have a generally rounded shape to avoid cutting the sheet stock 116 being converted to void fill material 118. However, other shapes and configurations are possible. For example, the crush wheels 80 may include paddles or may have pointed or squared protrusions.

As the crush wheels 80 rotate, the outermost surface of the protrusions 120 define a swept diameter 124, which is depicted by dashed circles around the crush wheels 80. In the closed operating mode shown in FIG. 9A, the crush wheels 80 rotate in meshed rotation, meaning the swept diameters 124 overlap one another. However, in FIG. 9B, the crush wheels 80 on the driven axle 104 are displaced as indicated by arrow P2 and the swept diameters 124 for the opposing crush wheels 80 no longer overlap. The increased spacing between the crush wheels 80 may be sufficient to lose traction of the sheet stock 116, thus alleviating, stopping, or preventing additional accumulation of void fill material 118 downstream of the crush wheels that is creating the jam in the first place.

FIGS. 10A & 10B show top views of the crush wheel drivetrain 82 with the spur gears 100, 102 and upper wall 84 clearly visible. As with the crush wheels shown in FIGS. 9A & 9B, the spur gears 100, 102 also operate in meshed rotation. As described above, the drive spur gear 100, is coupled to drive axle 98, which is rotated (via gears 94, 96) by motor 28. Drive spur gear 100, in turn, rotates driven spur gear 102 due to the meshed spur gear teeth 128. What is different with spur gears 100, 102 compared to crush wheels 80 is that even in the jammed or displaced position of FIG. 10A, the spur gear teeth 126 remain engaged. This is possible because the gear teeth 126 are longer than the protrusions 120 on the crush wheels 80. Consequently, the driven axle 104 and its coupled crush wheels 80 continue to rotate and maintain synchronous rotation with the crush wheels 80 mounted to the drive axle 98. Thus, when floating plates 108, 110 are able to return to their closed operating position (FIGS. 8A, 9A, 10A), the crush wheels 80 do not interfere with each other and are able to continue operating in meshed rotation with each other.

In the jammed or displaced position illustrated in FIGS. 9A & 10A, the downstream direction is illustrated by arrows D1. In the event of a jam, excess void fill material 118 accumulates downstream of the crush wheels 80. This buildup of excess material creates a back pressure that acts on the crush wheels 80 in an upstream direction indicated by arrow B1 in FIG. 9B. A benefit of the illustrated embodiment is that the floating plates 108, 110 pivot along an arcuate path indicated by arrows P2, P3 about pivot point 126. Pivot point 126 represents an attachment point at which the floating plates 108, 110 are secured to upper and lower walls 84, 86, respectively. Slots 114 in the floating plates 108, 110 define the extent of pivoting travel possible for the floating plates 110.

The pivot point 126 is located outside and downstream of the rotation axis A4 defined by driven axle 104. In this context, outside is defined to mean on a side of the rotation axis A4 that is opposite the drive axle 98. Similarly, downstream is defined as being on a same side of the rotation axis A4 as outlet chute 60. With the pivot point 126 thus located, the driven axle 104 is able to move away from the drive axle 98 in each of an outward and an upstream direction. Outward movement is important in that it provides the necessary spacing between crush wheels 80 so that they lose traction of the sheet stock 116, thus alleviating, stopping, or preventing additional accumulation of void fill material 118 downstream of the crush wheels 80. Moreover, upstream movement of the driven axle 104 is a natural response to the back pressure B1 applied to the crush wheels by the jam as shown in FIG. 9B. Thus, the driven axle 104 and its corresponding crush wheels 80 are able to move upstream in the same direction as the back pressure B1 as illustrated by deflection dimension D2 in FIG. 10B. The composite movement (both upstream and outward) also beneficially accommodates a large volume of sheet material to further prevent jams and damage.

Notably, the location of the pivot point 126 relative to the rotation axis A4 determines the relative amount of displacement possible in each of the outward and upstream directions. It may be desirable, as in the illustrated embodiments, to locate the pivot point 126 both outward and downstream of the rotation axis A4 to achieve beneficial displacement in the outward and upstream directions. In one embodiment, the pivot point 126 is located so that the driven axle 104 is able to be displaced in both the outward and upstream directions a similar amount. In another embodiment, the pivot point 126 is located so that the driven axle 104 is able to be displaced a larger amount in the outward direction and a lesser amount in the upstream direction. In another embodiment, the pivot point 126 is located so that the driven axle 104 is able to be displaced a lesser amount in the outward direction and a larger amount in the upstream direction.

Figure 11:
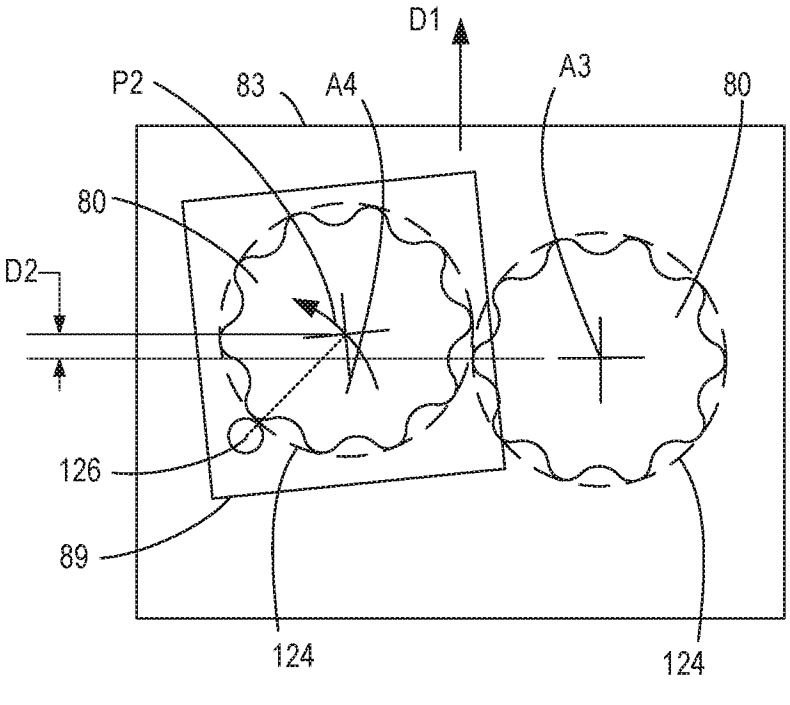
FIG. 11 is a schematic representation of a crush wheel mounted on a pivoting subframe according to one embodiment of the present invention.

In another embodiment, the pivot point 126 may be located both outward and upstream of the rotation axis A4 for displacement of the axle 104 in the outward and downstream directions. For example, FIG. 11 shows a simplified representation of a set of crush wheels 80, including a first set that is mounted on a frame 83 and a second set mounted on a pivoting subframe 89 that can be displaced in a direction indicated by arrow P2. Here, the downstream direction is indicated by the arrow D1 and the pivot point 126 is located upstream of the rotation axes A3, A4. Consequently, the second set of crush wheels 80 secured to the subframe 89 are able to deflect laterally outward and a distance D2 in the downstream direction.

FIG. 12 shows another simplified representation of a set of crush wheels 80 that are respectively mounted to a frame 83 and subframe 89. In other embodiments described above, the subframe 89 is able to pivot about a pivot point 126 with respect to the frame 83. In the alternative embodiment shown in FIG. 12, the subframe 89 is able to translate between closed and open positions with the guidance of one or more pins and slots. For instance, a set of pins 142 may be secured to frame 83 while subframe 89 is able to translate in a direction permitted by slots 140 formed in the subframe 89. In this embodiment, the slots are linear and permit linear displacement of the subframe 89 (and associated crush wheels 80) in a composite direction that includes some outward displacement and some upstream displacement indicated by dimension D2. In other embodiments, the slots 140 may be curved to permit arcuate displacement of the subframe 89 with respect to the frame 83.

The embodiments above have been described in terms of operating in one of a closed operating position or a jammed or displaced position. In reality, because of the compliancy offered by the floating plates 108, 110 and biasing elements 112, the crush wheels 80 attached to the driven axle 104 are able to float between these two extreme positions to naturally compensate for the volume of sheet stock 116 being fed through the machine 10. The strength of biasing element 112 can be adjusted as necessary to ensure reliable conversion of sheet stock 116 into void fill material 118. However excess biasing force is not strictly necessary. A void fill machine should propel the sheet stock 116 through the machine 10 in a smooth and reliable manner. The compliancy offered by the floating crush wheels 80 help achieve smooth operation. Furthermore, the floating crush wheels 80 described herein may reduce power consumed by motor 28 by reducing drag as sheet stock 116 is collapsed, folded, or creased by the crush wheels 80. Furthermore, the floating design may also accommodate different sizes (e.g., 15 or 30 inch widths) and densities (e.g., 30, 35, or 44 pound weights) of sheet stock 116 without the need to adjust spacing between the crush wheels 80.

An added benefit to the floating design is that it creates a mechanical feedback loop between the downstream and upstream sides of the crush wheels 80. If void fill material accumulates downstream of the crush wheels, the back pressure tends to separate the crush wheels 80, thus reducing the traction on the sheet stock, which reduces the feed rate on the inlet side. Similarly, once the back pressure on the downstream side subsides, traction at the crush wheels 80 increases and the feed rate on the upstream side increases.

Figure 13A:
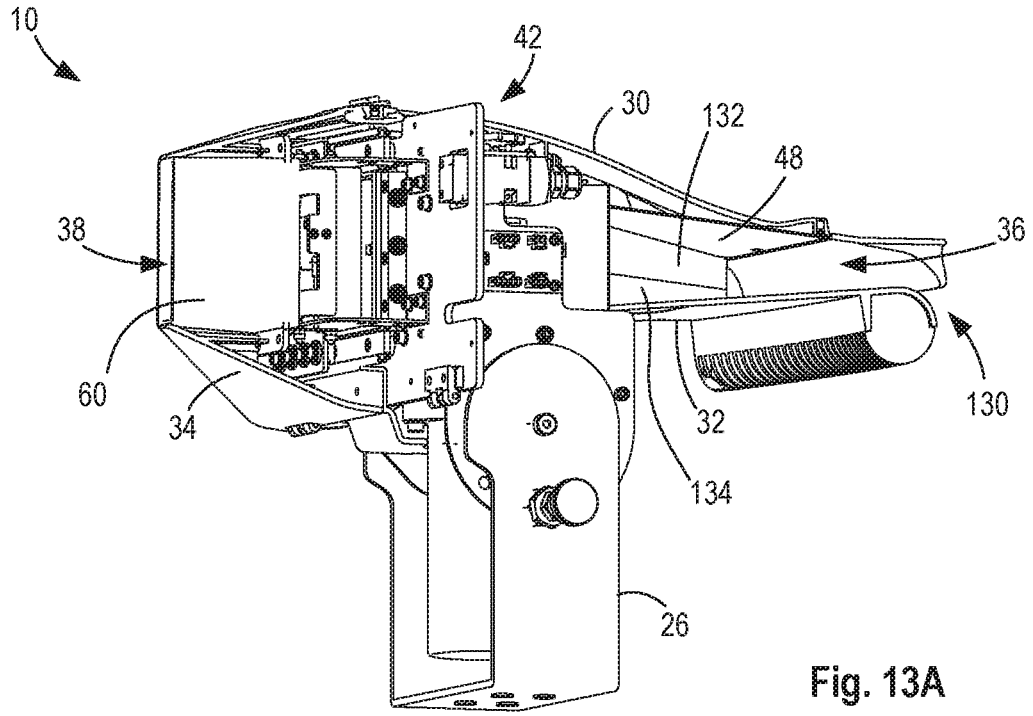
FIG. 13A is an isometric partial section view of a machine for producing void fill material according to one embodiment of the present invention.
Figure 13B:
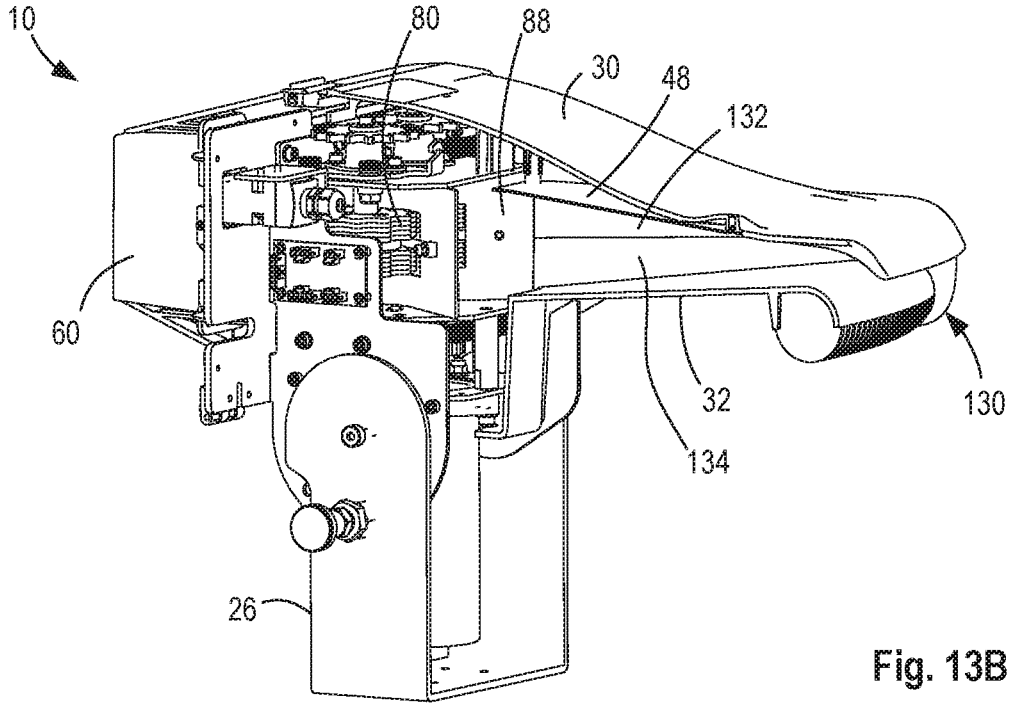
FIG. 13B is an isometric partial section view of a machine for producing void fill material according to one embodiment of the present invention.
Figure 13C:
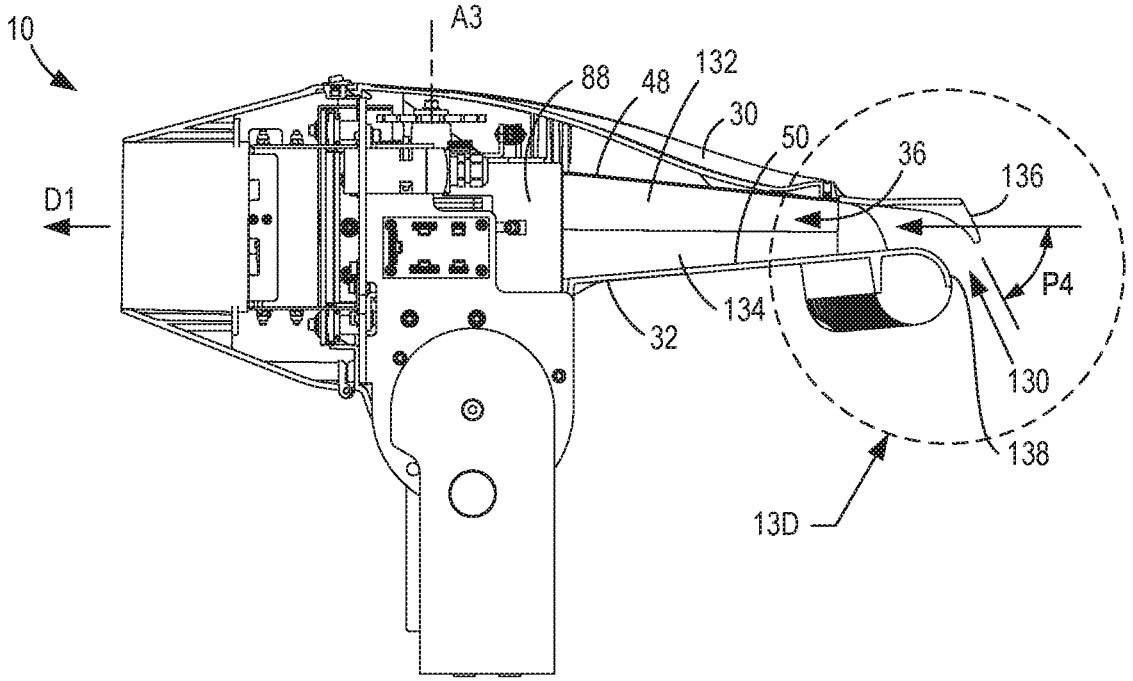
FIG. 13C is a side partial section view of a machine for producing void fill material according to one embodiment of the present invention.
Figure 13D:
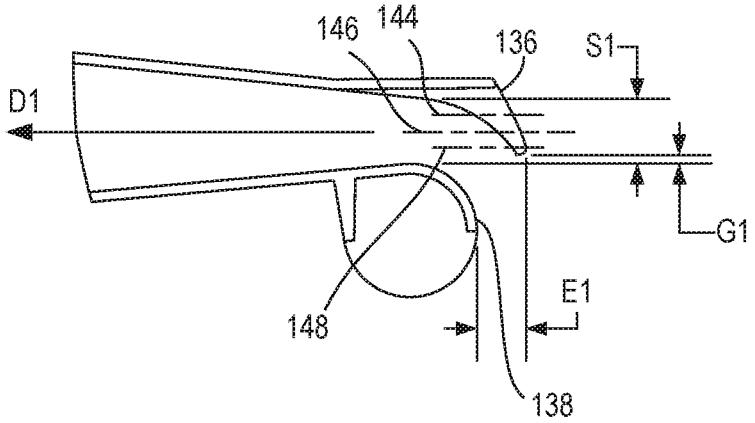
FIG. 13D is a simplified detail view of the inlet of the machine of FIG. 13C.

FIGS. 13A-D each show a partial cutaway view of the machine 10 from different angles. In each instance, the top, bottom, and outlet shells 30, 32, 34 are displayed as cut along a midline of the machine running from inlet port 130 to outlet port 38. Other components are shown in full. FIG. 13A shows an isometric view of the machine 10 looking generally from an outlet side and slightly beneath the machine. FIG. 13B shows an isometric view of the machine 10 looking generally from an inlet side and slightly above the machine. FIG. 13C shows a side view of the machine 10 with the downstream direction being generally right to left as shown by arrow D1. FIG. 13D shows a simplified detail view of the inlet port 130. As FIGS. 3 and 13A-13C illustrate, the size and shape of the inlet chute 36 changes between the inlet port 130 and the internal drive assembly 42. This shape change for the inlet chute 36 helps to immediately convert sheet stock 116 into a three dimensional material used for void fill. At the inlet port 130 to the inlet chute 36, the chute has a generally flattened shape to accept flat sheet stock 116. As the sheet stock 116 proceeds in a downstream direction, the sides of the inlet chute converge to decrease the width of the sheet stock 116. In the process, the height of the sheet stock 116 increases. Accordingly, the height of the inlet chute 36 increases in the downstream direction.

In the illustrated embodiment, the sides of the inlet chute 36 are defined by sidewalls 132, 134 on the top and bottom shells 30, 32. These sidewalls 132, 134 align to and cooperate with sidewalls 88 on the frame of the internal drive assembly 42 to progressively decrease the width of the sheet stock 116 from the inlet port 130 until the sheet reaches the crush wheels 80. The top and bottom of the inlet chute 36 are defined by inlet chute panel 48 attached to top shell 30 and chute surface 50 on the bottom shell 32. The chute surface 50 and chute panel 48 guide the sheet stock 116 into the volume between the upper and lower walls 84, 86, on the frame of the internal drive assembly 42. Furthermore, the chute surface 50 and chute panel 48 are closest to each other at an upstream location nearest the inlet port 130 and gradually diverge in a downstream direction, thus allowing the sheet stock 116 to grow in height until the sheet reaches the crush wheels 80.

The entrance to the inlet port 130 curves downward to easily accept sheet stock 116 from supply bin 16. In an alternative embodiment, the inlet port 130 may curve upwards to accept sheet stock that is stored above the machine 10. The shape of the inlet port 130 is defined in part by a rounded inlet surface 138 on the bottom shell 32, which helps to gradually turn the direction of travel for the sheet stock 116 from a generally vertical travel path to a generally horizontal travel path. An overhang 136 on the top shell 30 complements the shape of inlet surface 138 to further guide sheet stock 116 into the inlet chute 36. Certain dimensional characteristics of the inlet chute 36 can be defined relative to upstream and downstream directions that are taken along a midline of the machine 10 from the inlet chute 36 to the outlet chute 60 and perpendicular to the axis of rotation A3 for drive axle 98 and crush wheels 80. As in other Figures, this downstream direction is indicated in FIG. 13C by arrow D1. The upstream direction is simply opposite the downstream direction. In the illustrated embodiment, the overhang 136 extends beyond the inlet surface 138 in an upstream direction. Furthermore, inlet port 130 is angled downward relative to the downstream direction and indicated by angle P4. In some embodiments, the inlet port 130 is angled downward by an angle in the range between 45 and 75 degrees. In some embodiments, the inlet port 130 is angled downward by an angle in the range between 30 and 90 degrees. The overhang 136 and downward angled inlet port 130 provide a safety improvement over conventional "straight" designs in that the moving components of the internal drive assembly 42 are obscured and inaccessible. The downward angle of the inlet port 130 reduces the risk of an operator's fingers, jewelry or other foreign objects from entering the inlet chute 36. Furthermore, even though the inlet port 130 remains wide enough to accommodate a desired width of sheet stock 116, the inlet chute 36 may be shortened and the bulkiness of the machine 10 reduced compared to conventional designs. For instance, a lateral distance from the inlet port 130 to the crush wheels 80 may be less than 32 inches.

FIG. 13D shows a simplified detail view of the inlet port 130 and the overhang 136. In this particular embodiment, the overhang 136 extends at distance E1 beyond the inlet surface 138 on the bottom shell 32. In some embodiments, the distance E1 may be in the range between about 20-60 mm, though shorter or longer distances are possible as necessary to strike a balance between proper paper feed and operator safety. Furthermore, the overhang 136 extends downward to partially or completely close off a vertical gap between the top and bottom shells 30, 32. The gap, or spacing S1 between the top and bottom shells 30, 32 should be large enough to permit the sheet stock 116 to freely enter the inlet chute 36. Dimension S1 is taken along a direction perpendicular to the downstream direction D1 at a location where inlet surface 138 is closest to and begins to curve away from the upper shell 30. This dimension S1 may be between about 20-60 mm. In a conventional machine that does not include overhang 136, this representative gap dimension S1 increases the risk of an operator's fingers, jewelry or other foreign objects entering the inlet chute 36. In the illustrated embodiment, the vertical gap is obstructed by the overhang 136, which reduces the vertical gap to dimension G1. Dimension G1 is taken along the same direction and at the same location as dimension S1. Preferably, dimension G1 is small enough to reduce the risk of an operator's fingers, jewelry or other foreign objects from entering the inlet chute 36. The dimension G1 may be less than about 15-25 mm. In the illustrated embodiment, G1 is less than about one fourth of dimension S1. In other words, the overhang 136 extends downward to block about three fourths (indicated by graduated line 148) of the gap spacing S1. So, for example, if S1 is about 60 mm, G1 may be about 15 mm or less. Depending on the size of the vertical gap S1 and the amount of overhang extension E1, the overhang 136 may extend downward to block more or less of the gap. In one embodiment, the overhang 136 blocks substantially all of the gap. That is, the overhang 136 may extend below inlet surface 138, provided the extension distance E1 is large enough to allow the sheet stock 116 to enter the inlet port 130 and turn towards the downstream direction D1. In other embodiments, such as when spacing dimension S1 is smaller, the overhang 136 extends downward to block one fourth (graduated line 144) of the spacing S1. To give another example, if S1 is about 30 mm, G1 may be about 22 mm or less. In other embodiments, the overhang 136 extends downward to block one half (graduated line 146) of the spacing S1. To illustrate this example, S1 may be about 40 mm, and G1 may be about 20 mm. In each instance, G1 is substantially small to block fingers or foreign objects from direct, straight-line access to the hazardous drive train components within the machine 10.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For example, the crush wheels 80 in the illustrated embodiments are generally oriented in a vertical direction within the internal drive assembly 42. In an alternative embodiment, the drive and driven axles 98, 104, and crush wheels 80 may rotate about horizontally disposed rotation axles. The invention should therefore not be limited by the above described embodiment, method, and examples, but by all embodiments and methods within the scope and spirit of the invention as claimed.

What is claimed is:

1. A machine for converting sheet stock material into a three dimension void fill material, the machine comprising:

an inlet chute;

an outlet chute;

an internal drive assembly comprising a drive motor adapted to rotate a plurality of opposed crush wheels, the crush wheels adapted to pull the sheet stock from the inlet chute and to push the void fill material to the outlet chute all in a downstream direction, the internal drive assembly further comprising;

a frame securing the drive motor and a first power transmission set adapted to rotate a drive axle on which a first set of crush wheels are rotated;

a subframe securing a driven axle on which a second set of crush wheels are rotated, wherein a second power transmission set is adapted to rotate the driven axle in synchronous rotation with the drive axle about substantially parallel axes of rotation, and wherein the subframe is movably attached to the frame to permit displacement of the driven axle and second set of crush wheels caused by back pressure applied to the plurality of opposed crush wheels by the stock material;

wherein the wherein the subframe is pivotably attached to the frame at a pivot point located laterally outside of a space between the opposed crush wheels and at a position that allows the subframe and the driven axle to pivot at least partly in the downstream and upstream directions; and wherein the pivot point is located at a position downstream of the axes of rotation for the drive and driven axles and wherein the driven axle and second set of crush wheels are displaceable away from the drive axle and the first set of crush wheels at least partly in the upstream direction.

2. The machine of claim 1 wherein:

the first and second sets of crush wheels have protrusions that define an outer swept diameter;

when the driven axle and the second set of crush wheels are not displaced in the upstream direction, the outer swept diameters of the first and second set of crush wheels overlap; and when the driven axle and the second set of crush wheels are displaced in the upstream direction, the outer swept diameters of the first and second set of crush wheels do not overlap.

3. The machine of claim 2 wherein when the driven axle and the second set of crush wheels are displaced in the upstream direction and the outer swept diameters of the first and second sets of crush do not overlap, the second set of one or more gears continues to rotate the driven axle in synchronous rotation with the drive axle.

4. The machine of claim 1 wherein the subframe comprises first and second floating plates which movably secure first and second ends of the driven axle to the frame, each floating plate being independently movable and urged to a closed position by a biasing element.

5. The machine of claim 1 wherein:

the inlet chute further comprises an internal volume defined by opposed top and bottom walls and opposed side walls;

a spacing between the top and bottom walls is smallest at an upstream location nearest an inlet port and gradually increases in a downstream direction at a location nearest the crush wheels;

a spacing between the side walls is largest at an upstream location nearest the inlet port and gradually decreases in a downstream direction at a location nearest the crush wheels; and the inlet chute further comprises an angled inlet port having a lower inlet surface extending from the bottom wall and an upper overhang extending from the top wall and that extends beyond the lower inlet surface in the upstream direction, the upper overhang also being angled downward relative to the downstream direction.

6. The machine of claim 1, wherein the subframe is movably attached to the frame to permit displacement of the driven axle and second set of crush wheels caused by the back pressure applied to the plurality of opposed crush wheels by the stock material as the stock material is fed through the plurality of opposed crush wheels.

7. The machine of claim 6, wherein the displacement of the driven axle and second set of crush wheels as the stock material is fed further causes reduced traction between the plurality of opposed crush wheels and the stock material which causes a reduced feed rate of the stock material being pulled from the inlet chute.

8. The machine of claim 1, wherein the displacement of the driven axle and second set of crush wheels is at least partly in the downstream direction and an opposite upstream direction.

* * * * *